US005090666A

United States Patent [19]

May

[11] Patent Number: 5,090,666

[45] Date of Patent: Feb. 25, 1992

[54] HOIST APPARATUS

[76] Inventor: Marvin M. May, 529 S. Westgate Ave., Los Angeles, Calif. 90049

[21] Appl. No.: 554,080

[22] Filed: Jul. 17, 1990

Related U.S. Application Data

[63] Continuation of Ser. No. 257,330, Oct. 13, 1988, abandoned.

[51] Int. Cl.[5] ..... B66D 1/00

[52] U.S. Cl. ..... 254/333; 254/329

[58] Field of Search ..... 254/333, 332, 329, 277, 254/362, 383

[56] References Cited

U.S. PATENT DOCUMENTS

| | | | |
|---|---|---|---|
| 2,042,481 | 6/1936 | Patterson | 254/333 |
| 2,628,813 | 2/1953 | Arnold | 254/333 |
| 3,438,423 | 4/1969 | Melull et al. | 254/333 X |
| 3,481,584 | 12/1969 | Conry et al. | 254/329 X |
| 3,680,839 | 8/1972 | Mattinson | 254/333 X |
| 3,944,185 | 3/1976 | Evans | 254/383 X |
| 3,991,979 | 11/1976 | Mauldin | 254/362 X |
| 4,555,091 | 11/1985 | May et al. | 254/333 |
| 4,666,128 | 5/1987 | Bechmann | 254/329 |

FOREIGN PATENT DOCUMENTS 872987 4/1953 Fed. Rep. of Germany ..... 254/333

*Primary Examiner*—Katherine Matecki
*Attorney, Agent, or Firm*—Charles Silberberg

[57] ABSTRACT

An improved cable hoist apparatus has a sheave movably connected relative to a frame to bias the cable in a circumferential groove in the sheave. A biasing means on the frame compresses the cable in the sheave groove with the amount of force depending upon the tension in the cable. In this regard, the sheave is positioned relative to the frame as a function of the cable tension such that the greater the cable tension, the greater the biasing force on the cable. However, the biasing means can include a plurality of rollers to regulate the biasing force. A reeving spring can be used in conjunction with the biasing means to allow reeving of the hoist when the cable is unloaded. The hoist apparatus optimally incorporates certain advantageous safety features. These include a cable brake activated and released depending upon the position of the sheave and a motor shutoff as a function of overload and/or underload.

29 Claims, 5 Drawing Sheets

HOIST APPARATUS

This is a continuation of copending application Ser. No. 07/257,330 filed on Oct. 13, 1988, now abandoned.

FIELD OF THE INVENTION

This invention pertains to a hoist apparatus for raising or lowering a load along a cable and more particularly to an improved hoist apparatus which is simply constructed, light in weight, relatively inexpensive, easily serviced, allows for breech cable loading, incorporates advantageous safety features, and is highly reliable.

BACKGROUND OF THE INVENTION

Traction hoists move up and down a wire rope (cable) by creating friction between the wire rope and one or more sheaves and drums. Current traction hoists are exemplified by U.S. Pat. Nos. 4,139,178 and 3,944,185. These hoists include a motor, power transmission, cable driving sheave, cable tensioning sheave, a pressure exerting chain, and a number of brake mechanisms. These major components are all mounted to the same framework—a large casting, with the drive sheave radially stationary and the chain moving to bias the cable.

While the prior art hoists generally operate in a satisfactory manner, the mechanisms involved are heavy, complex, and require a relatively large number of moving parts. As a result, such devices are expensive and require significant service and maintenance. Reeving of the cable through many of the prior art hoists is a time consuming process, since it may involve passing an extensive amount of cable through the hoist. The cable is subject to excess wear by unnecessarily large forces pressing the cable against the drive sheave. Forces on the drive sheave, by virtue of its mounting to the overall framework, can be transmitted to the gearbox and gearbox shaft. This is particularly of concern in an overload (overhung) situation, where damage to these expensive parts could result (requiring as a precaution much heavier gearboxes and shafts). While the prior art devices do employ safety brakes, they typically work as a function of velocity of cable movement, i.e., overspeed brakes. However, it is also desirable to automatically brake the system in overload and underload situations.

SUMMARY OF THE INVENTION

It is, therefore, an object of the present invention to provide an improved hoist apparatus which is simply constructed, inexpensive, light in weight, easily inspected and serviced, and reliable.

It is another object of the invention to provide a hoist which allows for breech loading of the cable It is yet another object of the invention to provide a hoist which regulates the amount of force pressing the cable against the drive sheave.

It is still another object of the invention to provide a hoist which eliminates overhung loads on the gearbox.

It is another object of the invention to provide a hoist which is modular and comprised of two major parts instead of one overall part, the two major parts being individually lighter than the one overall part and easier to handle.

Lastly, it is another object of the invention to provide a hoist having efficient safety braking means, including one means which is sensitive to overload and underload conditions.

Briefly, in accordance with the invention, there is provided a hoist apparatus for moving a load along a cable which includes a frame, a cable biasing means, and a sheave. The cable biasing means is attached to the frame. The sheave is movably connected relative to the frame so that it is free to move relative to the frame within a limited range toward and away from the cable biasing means. The sheave has a circumferential peripheral groove which receives the cable. The cable biasing means biases the cable toward the groove when the sheave is positioned adjacent the cable biasing means. The sheave is movably positioned relative to the cable biasing means as a function of the tension in the cable. Preferably, the cable biasing means includes two pressure rollers and two rim rollers which divide the load on the cable biasing means between them. The cable biasing means can be rigidly attached to the upper frame so that it will not move vertically, regardless of the pressure between it and the cable. Alternately, the cable biasing means may also include a shaft movable with the roller assembly against a spring a distance that is proportional to tension in the cable. Positioning of the roller assembly under such circumstances may be used to activate a brake means or provide a measure of load conditions. Positioning of the sheave may be used to activate another brake means. In one embodiment of the invention, a reeving spring acts on the cable biasing means to allow reeving of the cable around the sheave by the motor.

Other objects and advantages of the invention will become apparent upon reading the following detailed description and upon reference to the drawings.

FIG. **9*a*** is a detail elevational view of the cable biasing means of a second embodiment of the invention, under circumstances where there is no biasing force on the cable.

FIG. **9*b*** is a detail elevational view of the cable biasing means of the second embodiment of the invention, under circumstances where there is a biasing force on the cable.

Figure 10:
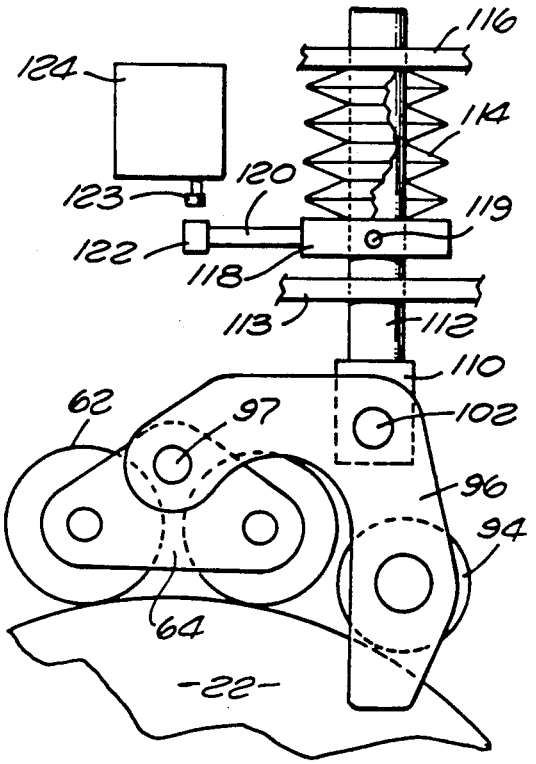

FIG. 10 is a detail elevational view of the cable biasing means of a third embodiment of the invention, illustrating a sensing means which cooperates with the cable biasing means to actuate a safety brake.

Figure 11:
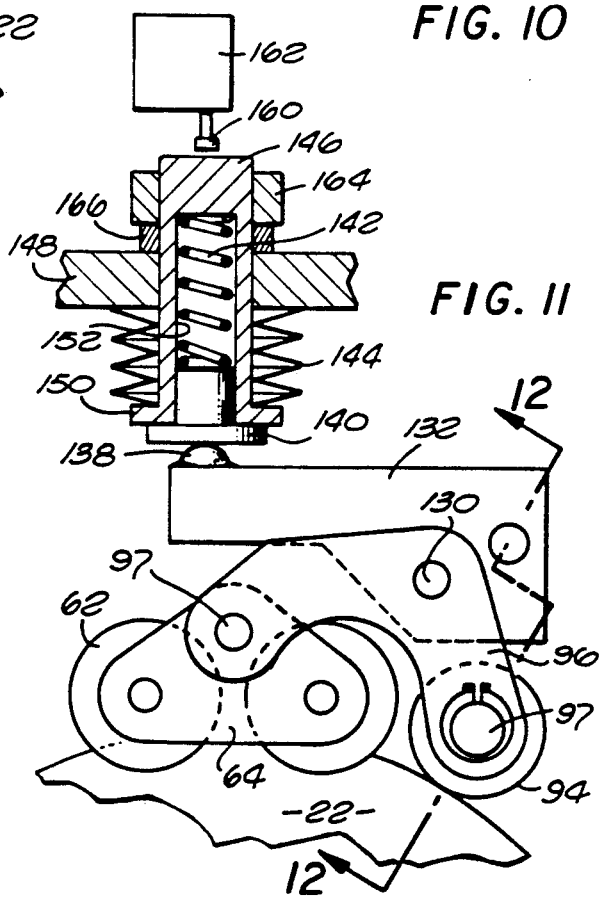

FIG. 11 is a detail elevational view of the cable biasing means of a fourth embodiment of the invention, illustrating a sensing means which cooperates with the cable biasing means to actuate a safety brake and a reeving spring which acts on the cable biasing means.

Figure 12:
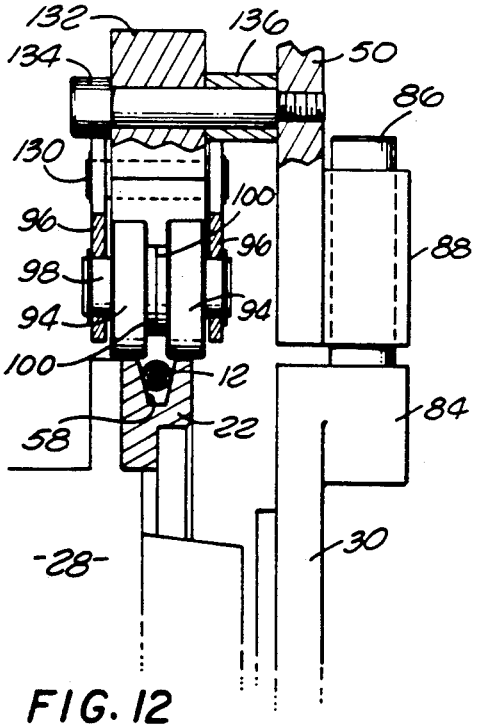

FIG. 12 is a fragmentary sectional elevational view taken along line 12—12 of FIG. 11 illustrating the rim rollers of the cable biasing means.

Figure 13:
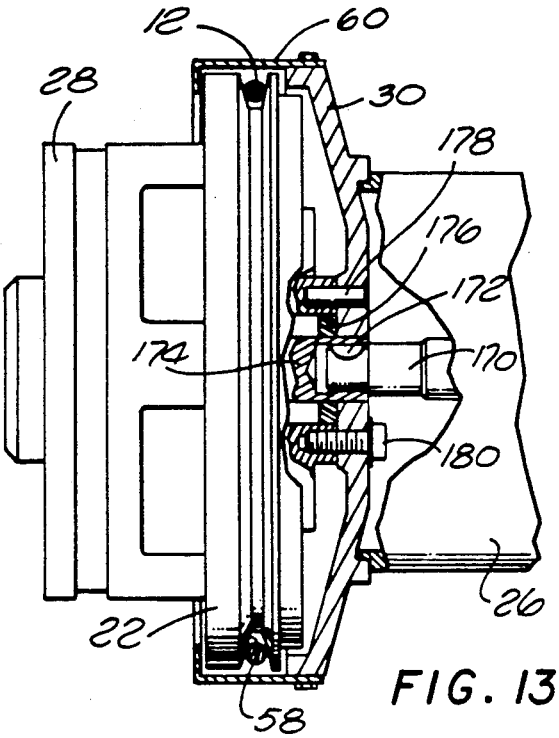

FIG. 13 is a fragmentary plan view with a portion broken away of the motor/gearbox/sheave assembly.

Figure 14:
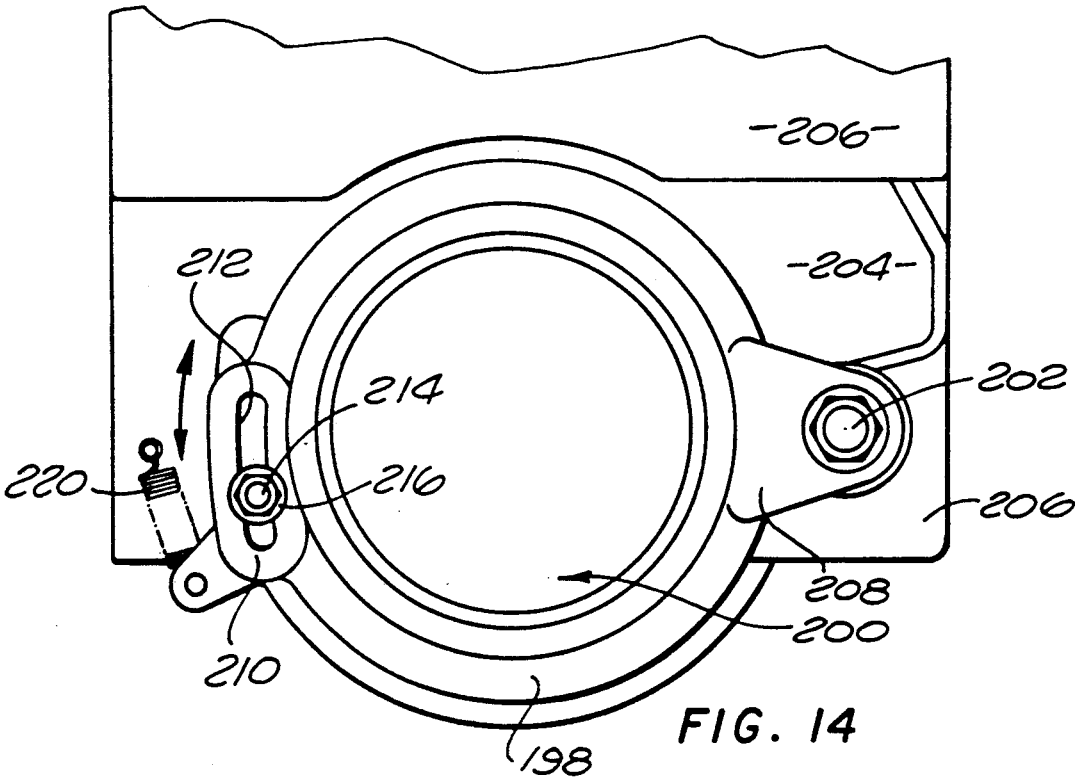

FIG. 14 is a fragmentary elevational view of the motor/gearbox/sheave assembly in accordance with another embodiment of the invention.

Figure 15:
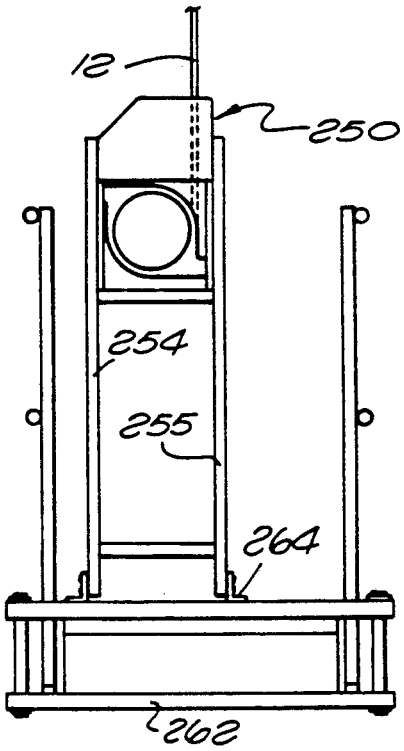

FIG. 15 is an elevational view of another embodiment of the invention illustrating the hoist connected to a load (platform).

Figure 16:
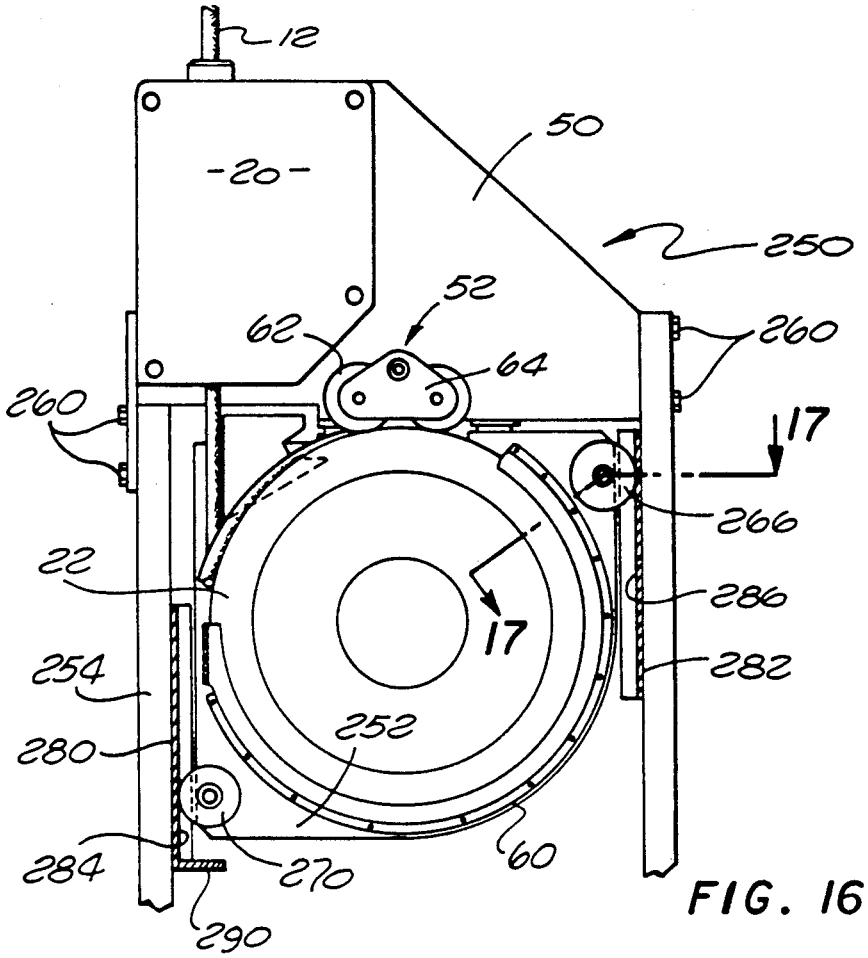

FIG. 16 a side elevational view of the hoist of FIG. 15 showing the connection of the stirrups to the hoist.

Figure 17:
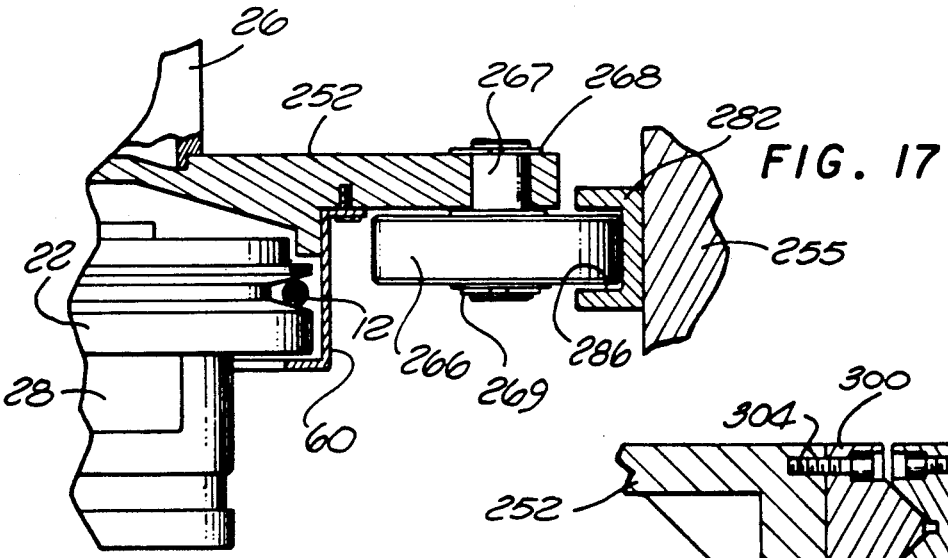

FIG. 17 is a fragmentary sectional plan view taken along line 17—17 of FIG. 16 illustrating a guide means for the upper and lower assemblies of the hoist.

Figure 18:
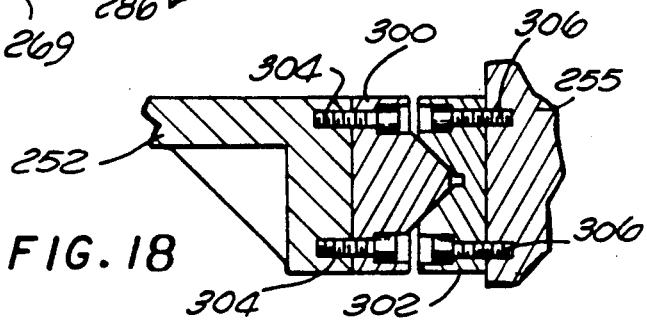

FIG. 18 is a detail sectional view of alternative guide means to that shown in FIG. 17.

While the invention will be described in connection with the preferred embodiments, it will be understood that it is not intended to limit the invention to those embodiments. On the contrary, it is intended to cover all alternatives, modifications, and equivalents which may by included within the spirit and scope of the invention as defined by the appended claims.

DETAILED DESCRIPTION OF THE INVENTION

Figure 1:
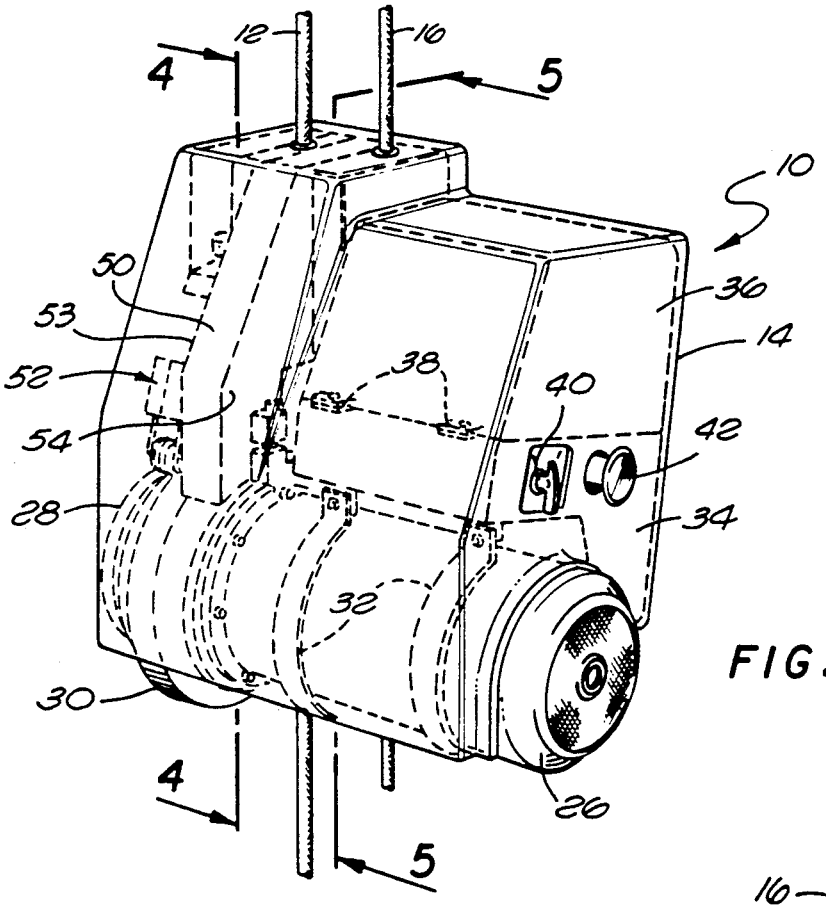
FIG. 1 is a perspective view of the improved hoist apparatus.
Figure 2:
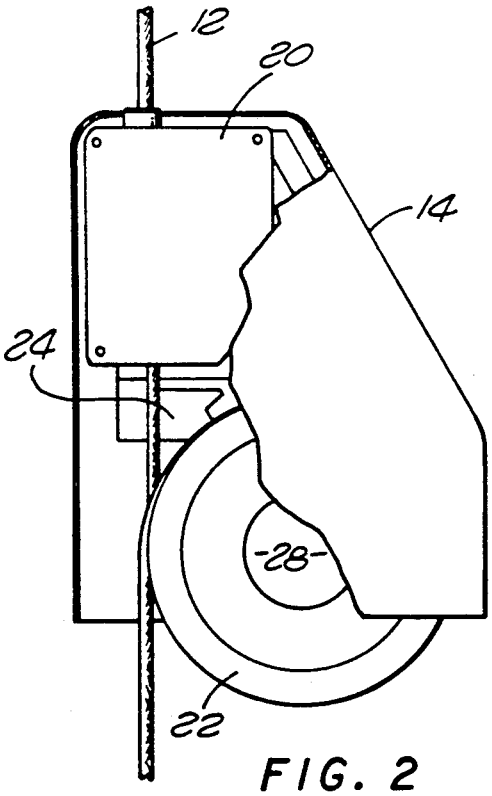
FIG. 2 is a side elevational view with a portion broken away of the hoist of FIG. 1.
Figure 3:
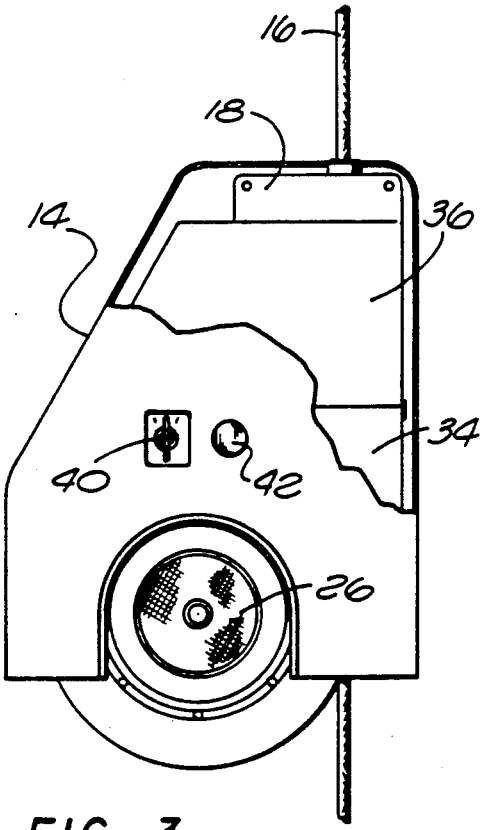
FIG. 3 is an elevational view of the other side of the hoist of FIG. 1, also with a portion broken away.
Figure 4:
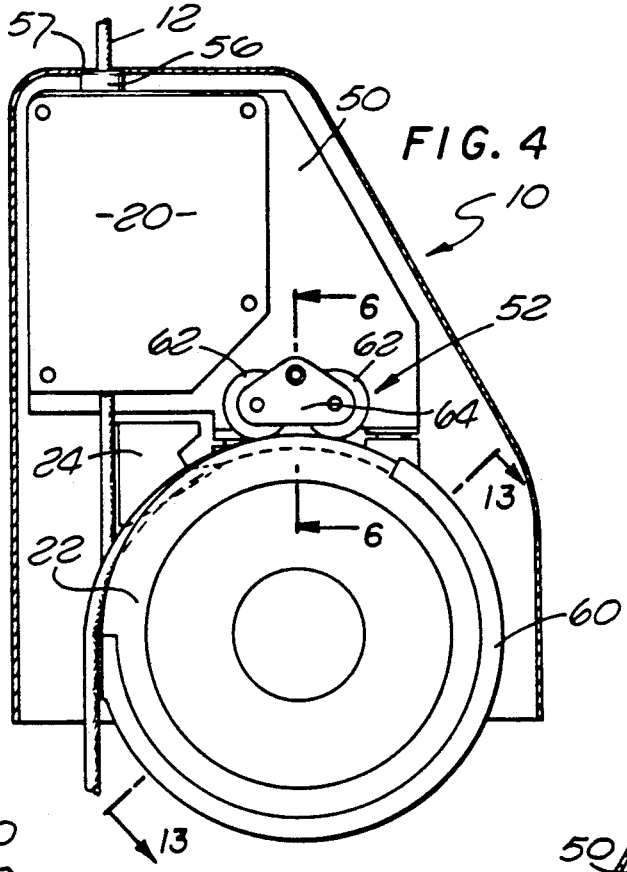
FIG. 4 is a sectional elevational view of the hoist of FIG. 1 taken along the line 4—4 illustrating a first embodiment of the invention.

Referring now to FIGS. 1, 2, and 3 there is illustrated the hoist apparatus of the present invention generally indicated at 10 which is enclosed within a housing 14. Moist 10 is drivingly related to a cable 12. The cable 12 is normally a flexible, steel, wire rope which will have a diameter based upon the maximum load to be lifted. Customarily, a separate cable ("slack rope") 16 is also used as part of the hoist apparatus as a safety device. Cable 16 passes through a safety braking means 18 which serves to automatically brake movement of hoist 10 with respect to cable 16 under certain conditions, e.g., an underload condition such as would occur if a load was accidentally lowered on a building obstruction, the severing of cable 12, etc. Cable 12 also is interconnected with a safety brake in the form of an overspeed governor means 20 Means 20 stops descent of the hoist 10 in the event downward velocity of hoist 10 relative to cable 12 exceeds a predetermined maximum. Cable 12, after passing through brake means 20 wraps around a sheave 22 and then is directed out of housing 14 by a diverter block 24.

Sheave 22 is part of a lower assembly which is also made up of motor 26, gearbox 28 and lower frame 30 preferably in the form of a casting. Sheave 22, motor 26, and gearbox 28 are mounted to casting 30. Mounted to the motor 26 via clamps 32 is electrical control box 34. A cover 36 is connected to box 34 at flanges 38. Associated with control box 34 is a switch 40 and emergency stop button 42. Switch 40 controls the direction of rotation of motor output which results in an up or down movement of hoist 10. Button 42 cuts power to motor 26 and can also be used to manually (by levers) actuate brake 20.

Hoist 10 also includes an upper assembly made up of frame 50, a cable biasing means generally indicated at 62 brake means 20, and brake means 18. Cable biasing means 62 and brake means 20 are connected to side 53 of frame 50 while brake means 18 is connected to side 64 of frame 50.

With reference to FIGS. 4, 5, 6, 7, and 8, there is shown a first embodiment of the invention. Cable 12, fixedly connected to some stable point on a building, for example, passes down through a bushing 56 within an opening 57 in the upper wall of housing 14. After entering hoist 10, cable 12 passes through overspeed governor means 20. Such a means is described in U.S. Pat. Nos. 3,944,185 and 4,139,178 the Specifications of which are incorporated herein by reference. In essence, cable 12 would be gripped between a braking cam and a slop, thereby braking movement of cable 12 through hoist 10 when cable speed through the hoist exceeds a predetermined limit. The braking cam is moved into the gripping position when the limit is exceeded.

Cable 12 after passing through governor means 20 is received within a circumferential peripheral groove 58 of sheave 22. Cable 12 passes almost completely around groove 58 to a diverter block 24 which guides the cable 12 out of groove 58, whereupon it proceeds out of housing 14. Diverter block 24 is mounted on casting 30 and has itself a grooved channel (not shown) which guides the cable 12 away from alignment with groove 58. A rigid stationary cable guide 60 is positioned concentrically around the lower portion of the periphery of sheave 22. Cable guide 60 can be an integral part of casting 30 or a separate member detachably mounted to casting 30 (which is preferred to enable breech loading). Cable guide 60 directs cable 12 into and around the periphery of sheave 22 when cable 12 is first reeved into hoist 10 and also keeps cable 12 from coming out of groove 58 when cable 12 is not under tension.

In this embodiment the cable biasing means 62 comprises a roller assembly which is rigidly connected to frame 50. Shown are two pressure rollers 62 mounted for rotation between two triangular shaped brackets 64 and 65. While one pressure roller could be used, two are preferred in order to divide the applied loads between them (when pressure rollers 62 compress cable 12 against sheave 22 as discussed hereinafter) pressure rollers 62 are mounted on axles 66 which are fastened to brackets 64 and 65. On each side of pressure rollers 62 are spacers 68. The assembly is fastened to frame 50 by a bolt 70. Spacers 72 and 74 fit respectively around the bolt 70 between brackets 64 and 65 and between bracket 65 and frame 50 pressure rollers 62 have grooved peripheries adapted for engaging the outwardly directed surface of cable 12 when it is received in the groove 68 of sheave 22.

Figure 6:
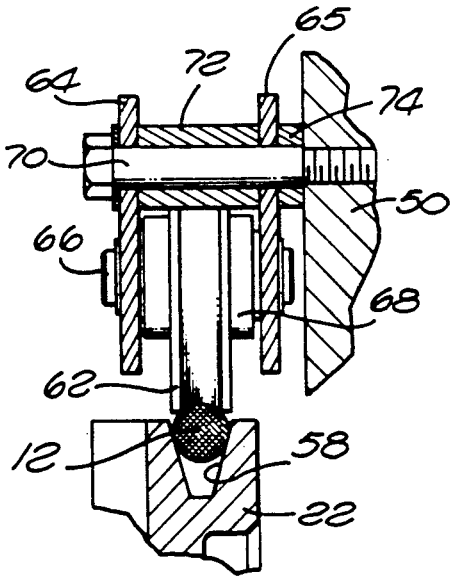
FIG. 6 is a fragmentary sectional elevational view taken along line 6—6 of FIG. 4 illustrating the cable biasing means of the first embodiment.
Figure 7:
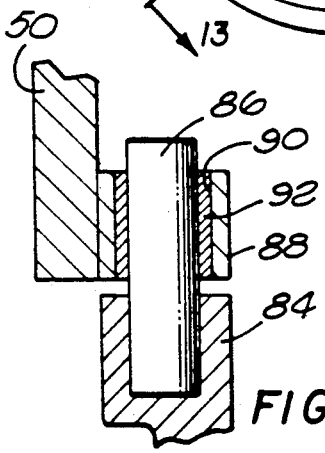
FIG. 7 is a fragmentary sectional elevational view taken along line 7—7 of FIG. 5 illustrating details of the means aligning the frame and sheave.
Figure 5:
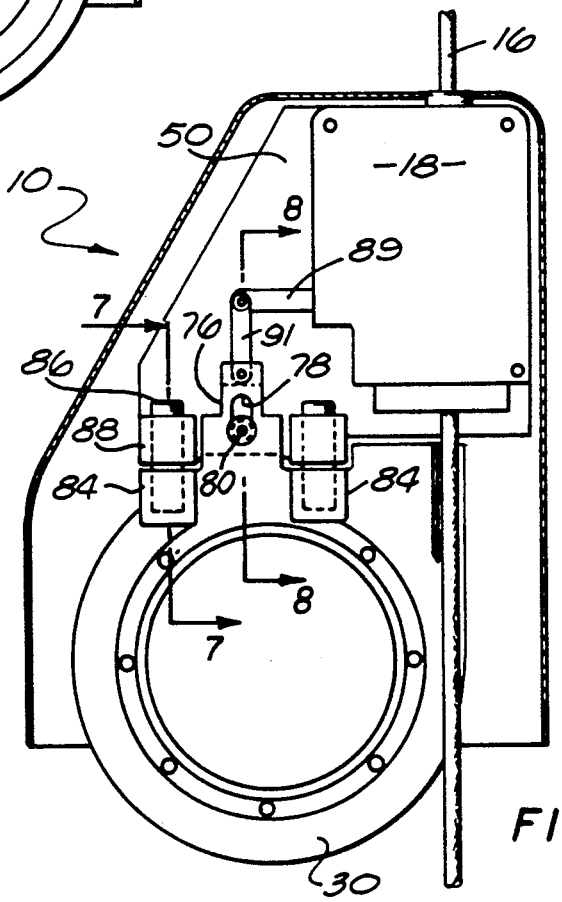
FIG. 5 is a sectional elevational view of the hoist of FIG. 1 taken along the line 5—5.

FIGS. 5-7 illustrate the movable connection of frame 50 to casting 30. Casting 30 has an integral upwardly extending flange 76 which has a vertically extending slot 78 therein. A shoulder bolt 80 connected to frame 50 fits within slot 78. A washer 82 retains the bolt 80 within slot 78. With this connection, the lower assembly (casting 30/sheave 22/motor 26/gearbox 28) is vertically movable relative to the upper assembly (frame 50/cable biasing means 52) within a limited range, i.e., the length of movement of bolt 80 within slot 78.

To keep the lower assembly from rotating and to maintain vertical alignment of the upper and lower assemblies, a plurality of guide members are used. Flanged on casting 30 are two hollow guide blocks 84. Mounted within the bore of each block 84 is a guide pin 86. On frame 50 are mating tubular guide block flanges 88. Flanges 88 each have a central bore 90 in vertical alignment with and sized to accomodate pins 86. Bushings 92 can be fit within bore 90 of each flange 88 for ease of movement of pins 86. As should be understood, pins 86 move up and down within flanges 88 with relative vertical movement of the lower and upper assemblies. This is done without hindering such relative vertical movement while acting to maintain vertical alignment of the upper and lower assemblies.

In the operation of this embodiment, a load, such as scaffolding carrying personel and equipment along the face of a building, is attached to frame 50 and forces the upper assembly and more specifically the cable biasing means 52 vertically toward the lower assembly. Similarly, tension in the cable 12 forces the lower assembly and more specifically the sheave 22 vertically toward the upper assembly. This results in cable 12 being biased by the pressure rollers 62 into groove 58 of sheave 22. The amount of force on the cable 12 will be proportional to the tension in cable 12. By virtue of this biasing force pressing the cable 12 into the groove 58, the frictional force between the cable 12 and sheave 22 is increased so as to prevent slippage between sheave 22 and cable 12. In this manner rotational movement of sheave 22 is translated to vertical movement of hoist 10 along cable 12.

Many of the advantages of the invention should now be understood. Hoist 10 is simply constructed, inexpensive, lightweight, has relatively few moving parts, is easily serviced, and is reliable. It can simply be breech loaded by moving apart or disconnecting the upper and lower assemblies (this also simplifies service, handling, and maintenance). Overhung loads on the gearbox shaft are eliminated as all vertical forces from the cable biasing means and the tension in the cable are absorbed by the sheave 22 rather than being transmitted to the gearbox Because the force on cable 12 is proportional to the load being raised, less pressure is exerted on the cable 12 for light loads, thereby increasing cable useful life, risk of cable slippage is reduced since traction adjusts upward with load, and the possibility of rope jam is reduced during reeving/dereeving as there is insufficient traction to force damaged cable movement.

Figure 8:
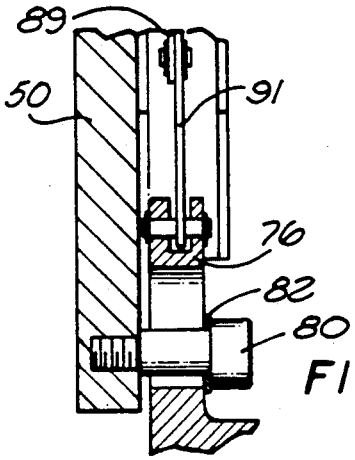
FIG. 8 is a fragmentary sectional elevational view taken along line 8—8 of FIG. 5 illustrating further details of the means aligning the frame and sheave.

FIGS. 5 and 8 also illustrate an advantageous slack rope brake. Pinned to the upper edge of casting flange 76 is a link 91 which is connected to another link 89. Link 89 is suitably mechanically connected to the slack rope brake 18. Brake means 18 like brake means 20 would also preferably have a cam and stop member between which cable 16 would pass. However, instead of having a cable speed dependent mechanism to actuate the brake means 18 to cause the cam and stop to clamp the cable 16, the cam is simply moved to its clamping position by virtue of movement of link 89 (which could directly position the cam). Thus, downward movement or position of sheave 22 due to lack of tension in cable 12 would move (or leave) link 89 down which would position the brake cam of means 18 in its clamping or braking position. Overall, this brake system is simpler, lighter in weight, and allows for braking over a broader scope of appropriate conditions.

Figure 9A:
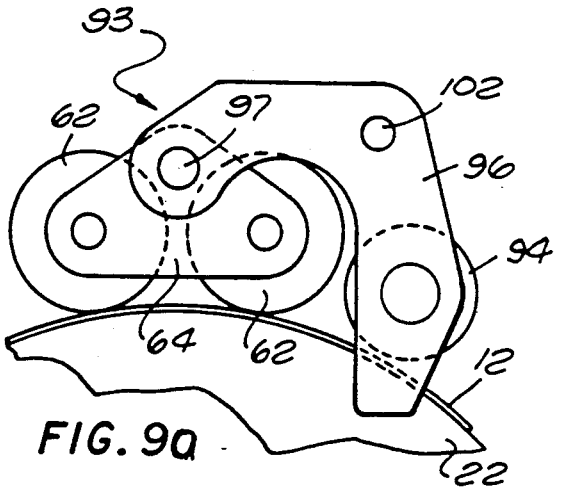
Figure 9B:
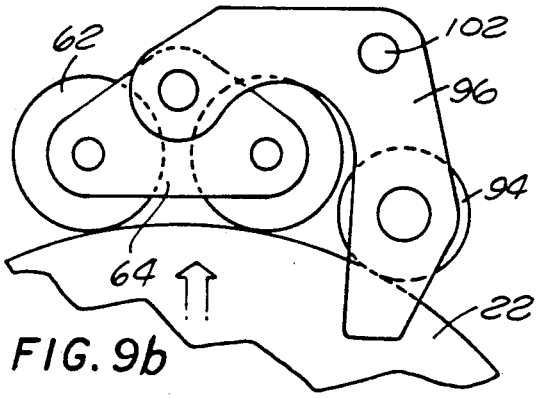

A second embodiment of the invention is shown in FIGS. 9*a* and 9*b*. Here the cable biasing means 93 also includes rim rollers 94. Rim rollers 94 (which are shown in more detail in FIG. 12) are mounted for rotation between a pair of bell crank brackets 96. Rim rollers 94 are mounted on an axle 98 which is fastened to brackets 96. Between rim rollers 94 are spacers 100 which position rim rollers 94 such that they bear against both outer edges of groove 58 while bridging the groove itself and cable 12. Alternately, one rim roller with a central groove would work equivalently. Bell crank brackets 96 are fastened to brackets 64 and 65 at the end opposite to that which connects the rim rollers 94 by a shaft 97 which passes through brackets 64, 65, and 96. The shaft 97 is clamped (not shown) at both ends outside brackets 96. The only connection of cable biasing means 93 to frame 50 is pivotally at 102.

A major advantage of cable biasing means 93 is that it allows for regulating the pressure on the cable 12. In FIG. 9*a* there is minimal cable tension and only the pressure rollers 62 contact the cable 12. The cable 12 is shown protruding from groove 58 under such circumstances. However, when the cable tension increases and the cable biasing means 93 and sheave 22 are moved toward each other, the cable 12 is compressed between cable biasing means 93 and sheave 22 and biased into groove 58. Mere the force bearing against cable 12 is reduced by the amount of the load taken up by the rim rollers 94 and absorbed by the rim of sheave 22. The allocation of forces between the pressure rollers 62 and rim rollers 94 can be determined by the relative arm lengths of bell crank brackets 96. Thus, if the arm length from axle 98 to connection 102 is smaller than the arm length from shaft 97 to connection 102, as shown, then the force directed to the rim rollers 94 is proportionally greater preferably, approximately ⅔ of the force is directed to the rim rollers.

FIG. 10 illustrates a third embodiment. It is the same as FIG. 9*a* except for the addition of an overload mechanism and the connection to frame 60 ( which is only at brackets 113 and 116). A hollow block 110 is connected between brackets 96. Block 110 supports a shaft 112. Shaft 112 is vertically movable between aligned holes in brackets 113 and 116. Bracket 113 acts as a stop for up and down movement of shaft 112. Mounted around shaft 112 is a spring 114. Spring 114 is positioned between support bracket 116 and a plate 118 which is pinned to shaft 112 at 119. Attached to plate 118 for movement therewith is a rod 120 with an enlarged end 122. Position of rod 120 is a measure of load conditions and can advantageously be used for indicating or taking action with respect to overload and/or underload conditions. Thus, in an overload condition, bracket 96 would move upwardly overcoming tension of spring 114 and moving rod 120 upward (the degree of which depends on the magnitude of the load) such that end 122 contacts lever 123 of switch 124. Switch 124 can be used to cut off power to the motor 26 in the up direction. Similarly, another switch (not shown) positioned below rod 120 can be used for underload conditions to cut Off motor power in the down direction. Alternately, switch 124 could be used to actuate a brake means.

FIGS. 11 and 12 show another embodiment. Mere brackets 96 are connected together and to a lever 132 with a shaft 130. Lever 132 is pivotally connected to frame 50 by bolt 134. Bolt 134 is spaced from frame 50 by a bushing 136 which allows for rotation of lever 132. Lever 132, which serves to increase the transmitted motion of brackets 96, has an upwardly protruding knob 138 which is contacted by spring loaded plug 140. Plug 140 is biased by a reeving spring 142 against knob 138. Reeving spring 142 downwardly biases lever 132 and in turn pressure rollers 02 such that pressure rollers 62 will bias cable 12 into groove 58 even when there is no tension in cable 12. This creates enough traction to allow for reeving (or dereeving) cable 12 and lifting the unloaded hoist 10 until it begins to lift the load. Several disc springs 144 are positioned around a hollow cylinder 146 between a bracket 148 and the lower flanged end 150 of cylinder 146. Bracket 148 is fixed to frame 50. Reeving spring 142 and plug 140 fit within the bore 152 of cylinder 146. Cylinder 146, which passes through bracket 148 may move up or down depending on load on the hoist 10. A load forcing brackets 96 upward will in turn act to pivot lever 132 upward. This will be opposed by reeving spring 142 and spring 144. If the load is great enough, cylinder 146 will be moved upwardly. Like the FIG. 10 embodiment, in an overload situation, the lever 160 of switch 162 will be activated, this time by the top of cylinder 146, whereby power to the motor in the up direction will be out off. A nut 164 and spacer 166 which fit around the upper end of cylinder 146 act as a stop for downward movement of cylinder 146 (by contacting bracket 148).

FIG. 13 illustrates the connection of the lower assembly—sheave 22, motor 26, casting 30, and gearbox 28. Motor shaft 170 is keyed at 172 to gearbox input shaft 174 which is mounted for rotation between bearing 176. The stationary shaft 175 of gearbox 28 is connected to casting 30 with fasteners 178 and 180. Sheave 22 is mounted for rotation with gearbox 28. Suitable gearing (not shown) would be used to connect gearbox shaft 174 to the housing of gearbox 28 to control rotation of sheave 22. Cable guide 60 is mounted to casting 30 to retain cable 12 within groove 58 as previously described.

FIG. 14 illustrates an alternate approach to mount the lower assembly to obtain the relative movement of the sheave to the cable biasing means. In this embodiment, the casting 198, which forms a part of the lower assembly (sheave, motor, casting, and gearbox) which is generally indicated al 200, is pivotally connected at 202 to a plate 204. Fastener 202 connects flange 206 of plate 204 and integral bracket 208 of casting 198. Also integral with casting 198 is flange 210 which bas a slot 212 therethrough. A bolt 214 mounted in plate 204 protrudes through slot 212. A washer 216 retains bolt 214 in slot 212. Lower assembly 200 is thus able to pivot up or down relative to upper frame 206 within the range of movement of slot 212 around bolt 214. A cable biasing means (not shown) such as in FIG. 9*a* would be mounted on upper frame 206 to engage the sheave of lower assembly 200 when the sheave of lower assembly 200 is positioned adjacent thereto, i.e., when there is tension in the cable 12. A reeving spring 220 mounted to plate 204 may be used to bias the lower assembly 200 upward to create a reeving force between the sheave and cable biasing means on cable 12.

Referring now to FIGS. 15–17, there is shown another embodiment of the invention. In this embodiment, the stirrups which join the hoist to the load are used to further stabilize the hoist. This hoist generally indicated at 250 includes the same components as hoist 10, only with some additions and a larger lower assembly casting designated 252. Identical elements of previous embodiments are designated the same for convenience. Stirrups 254 and 255 are connected to frame 50 of hoist 250 with fasteners 260 and to platform 262 with brackets 264. Roller 266 is mounted for rotation with a shaft 267 and clips 268 and 269 to casting 252 at an upper extended edge of casting 252. Roller 270 is similarly mounted to a lower extended edge of casting 252 located opposite to the upper edge. Thus roller 266 is positioned adjacent stirrup 255 at the upper portion of casting 252 while roller 270 is positioned adjacent stirrup 254 at the bottom of casting 252. Mounted to stirrups 264 and 255 are vertical guide strips 280 and 282 respectfully. Guide strip 280 has a longitudinal groove 284. Strip 282 likewise has a longitudinal groove 286. Roller 266 is positioned to rotate within groove 286. Similarly, roller 270 is positioned to rotate within groove 284. Because of the positoning of rollers 266 and 270 in vertical grooves, they may only move vertically. This allows the relative movement of casting 252 and attached sheave 22 vertically toward and away from frame 50 and cable biasing means 52. A flange stop 290 at the bottom of strip 280 prevents separation of the lower assembly from the hoist 250 (and limits the relative movement of sheave 22 to cable biasing means 52). By only allowing vertical movement of casting 252, the mounting of rollers 200 and 270 within grooved guides 282 and 280 maintains vertical alignment of sheave 22 and cable biasing means 52, and keeps the lower assembly from rotating, i.e., due to turning moment from the load and from the location of the motor 26 cg. The guide means of this embodiment may by used in addition to or as an alternate to that shown in FIG. 5—blocks 84 and 88 with pins 86.

FIG. 18 illustrates an alternative to using rollers 266 and 270. This is to use male and female vee guides 300 and 302 respectively. For example, vee guide 300 would be used instead of roller 266 and connected to casting 252 by fasteners 304. Vee guide 300 engages female vee guide 302 (which replaces guide 282) which is connected to stirrup 255 with fasteners 306. The result is the same with guide 300 able to vertically slide within guide 302 while keeping the casting 252 {and therefore the lower assembly) from rotating.

Thus, it is apparent that there has been provided, in accordance with the invention, a hoist apparatus that fully satisfies the objectives, aims, and advantages set forth above. While the invention has been described in connection with specific embodiments thereof, it is evident that many alternatives, modifications, and variations will be apparent to those skilled in the art in light of the foregoing description. Accordingly, it is intended to embrace all such alternatives, modifications, and variations which will fall within the spirit of the appended claims.

What is claimed is:

1. A hoist apparatus for moving a load along a cable comprising:

a frame;

cable biasing means attached to said frame;

a rotatably mounted traction sheave, said sheave also mounted for movement relative to said frame within a limited range toward and away from said cable biasing means, said sheave having a circumferential peripheral groove receiving the cable, said cable biasing means pressing the cable into said groove when said sheave is positioned adjacent said cable biasing means such that a frictional force between said cable and said sheave is produced which allows rotational movement of said sheave to translate into corresponding movement of the hoist along the cable; and a cable guide means mounted within said host for movement with said sheave relative to said frame, said guide means directing the cable around said sheave when the cable is reeved into the hoist and maintaining the cable within said groove when the cable is slack.

2. The hoist of claim 1 wherein said sheave is connected to said frame.

3. The hoist of claim 1 wherein aid sheave is moved within said range toward and away from said cable biasing means depending upon amount of tension in said cable.

4. The hoist of claim 3 wherein said sheave is connected for pivotal movement relative to said frame.

5. The hoist of claim 1 wherein the load is connected to said frame, and said cable is pressed into said groove with a force depending upon the amount of tension in the cable.

6. The hoist of claim 1 also including a motor, said motor being connected to said sheave for selectively rotating said sheave and for movement with said sheave relative to said frame.

7. The hoist of claim 6 wherein said cable biasing means is attached to said frame in a manner which allows for a limited amount of movement of said cable biasing means relative to said frame toward and away from said sheave and also including a reeving spring acting on said cable biasing means when the tension in said cable is minimal such that said cable biasing means will be positioned to bias said cable with a tractive force sufficient to allow reeving of said cable around said sheave by said motor.

8. The hoist of claim 6 also including a cable guide means mounted for movement with said sheave relative to said frame, said guide means directing the cable around said sheave when the cable is reeved into the hoist and maintaining the cable within said groove when the cable is slack.

9. The hoist of claim 1 wherein said cable biasing means includes two pressure rollers, said pressure rollers bearing against the cable when said sheave is positioned adjacent said cable biasing means, whereby the load on said cable biasing means is divided between said pressure rollers.

10. The hoist of claim 9 wherein said cable biasing means also includes two brackets, said pressure rollers being rotatably connected to said brackets between said brackets, said brackets being connected to each other and said frame.

11. The hoist of claim 1 wherein said cable biasing means includes a pressure roller, two brackets and a rim roller, said pressure roller being rotatably connected to said brackets between said brackets, said pressure roller bearing against the cable when said sheave is positioned adjacent said cable biasing means, said brackets being connected to each other, said rim roller being movably connected to said brackets, said rim roller being positioned to contact the periphery of said sheave without contacting the cable when said sheave is positioned adjacent said cable biasing means such that load on said cable biasing means is divided between said pressure roller and said rim roller, whereby the corresponding pressing force on the cable into the groove is governed accordingly.

12. The hoist of claim 11 also including two bell crank brackets, said rim roller being rotatably connected to said bell crank brackets between said bell crank brackets, said bell crank brackets being pivotally connected to said brackets, each of said bell crank brackets having two arms of predetermined lengths, one arm connected to said brackets and the other arm connected to said rim roller, whereby the relative lengths of said arms govern the division of the load on said cable biasing means between said pressure roller and said rim roller.

13. The hoist of claim 12 also including a motor, said motor being connected to said sheave for selectively rotating said sheave and for movement with said sheave relative to said frame, and wherein said cable biasing means is attached to said frame in a manner which allows for a limited amount of movement of said cable biasing means relative to said frame toward and away from said sheave and also including a reeving spring acting on said cable biasing means when the tension in said cable is minimal such that said cable biasing means will be positioned to bias said cable with a tractive force sufficient to allow reeving of said cable around said sheave by said motor.

14. The hoist of claim 11 wherein said cable biasing means is attached to said frame in a manner which allows for a limited amount of movement of said cable biasing means relative to said frame toward and away from said sheave and also including a motor and a sensor means, said motor being connected to said sheave for selectively rotating said sheave and for movement with said sheave relative to said frame, said sensor means being responsive to the position of said cable biasing means for selectively controlling said motor to stop rotation of said sheave.

15. The hoist of claim 14 also including a reeving spring acting on said cable biasing means when the tension in said cable is minimal such that said cable biasing means will be positioned to bias said cable with a tractive force sufficient to allow reeving of said cable around said sheave by said motor.

16. The hoist of claim 6 wherein said cable biasing means includes a pressure roller, said pressure roller bearing against the cable when said sheave is positioned adjacent said cable biasing means, and wherein said pressure roller is movable within a limited range toward and away from said sheave, and also including sensor means responsive to the position of said pressure roller for selectively controlling said motor to stop rotation of said sheave.

17. The hoist of claim 16 also including a reeving spring acting on said pressure roller when the tension in said cable is minimal such that said pressure roller will be positioned to bias said cable with a tractive force sufficient to allow reeving of said cable around said sheave by said motor.

18. The hoist of claim 1 also including a brake means for halting hoist movement relative to the cable, said brake means being activated and released dependent upon the position of said sheave relative to said frame.

19. The hoist of claim 18 also including a second cable passing through said hoist, said second cable being substantially slack, said brake means acting on said second cable when activated to halt vertical movement of the hoist.

20. The host of claim 1 also including a casting and a frame guide means, said sheave mounted for movement with said casting, said casting mounted to said frame to allow said limited range of movement of said sheave, said frame guide means mounted on said frame and said casting, said frame guide means keeping said casting vertically aligned with said frame.

21. The hoist of claim 1 wherein said sheave is connected for pivotal movement relative to said frame.

22. The hoist of claim 1 also including:

a casting, said sheave mounted for movement with said casting;

two stirrups connected to said frame, said sheave positioned between said stirrups; and frame guide means mounted to said casting and said stirrups, said frame guide means keeping said casting vertically aligned with said frame.

23. The hoist of claim 22 wherein said frame guide means governs said limited range of movement of said sheave.

24. The hoist of claim 23 wherein said frame guide means includes two roller guides, one connected to one of said stirrups and the other connected to the other stirrup, said frame guide means also including two rollers mounted to said casing, said rollers positioned for movement within said roller guides, said guides acting on said rollers to resist turning moments on said casting relative to said frame and keep said casing vertically aligned with said frame.

25. The hoist of claim 22 wherein said frame guide means includes two roller guides, one connected to one of said stirrups and the other connected to the other stirrup, said frame guide means also including two rollers mounted to said casting, said rollers positioned for movement within said roller guides, said guides acting on said rollers to resist turning moments on said casting relative to said frame and keep said casting vertically aligned with said frame.

26. The hoist of claim 1 wherein said sheave is mounted such that it is positioned below said cable biasing means.

27. A hoist apparatus for moving a load along a cable comprising:

a frame;

cable biasing means attached to said frame;

a rotatably mounted traction sheave, said sheave also mounted for movement relative to said frame with a limited range toward and away from said cable biasing means, said sheave having a circumferential peripheral groove receiving the cable, said cable biasing means pressing the cable into said groove when said sheave is positioned adjacent said cable biasing means such that a frictional force between said cable and said sheave is produced which allows rotational movement of said sheave to translate into corresponding movement of the hoist along the cable;

a casting, said sheave mounted for movement with said casting, said casting mounted to said frame to allow said limited range of movement of said sheave; and frame guide means mounted on said frame and said casting, said frame guide means keeping said casting vertically aligned with said frame.

28. A hoist apparatus for moving a load along a cable comprising:

a frame;

cable biasing means attached to said frame;

a rotatably mounted traction sheave, said sheave also mounted for movement relative to said frame within a limited range toward and away from said cable biasing means, said sheave having a circumferential peripheral groove receiving the cable, said cable biasing means pressing the cable into said groove when said sheave is positioned adjacent said cable biasing means such that a frictional force between said cable and said sheave is produced which allows rotational movement of said sheave to translate into corresponding movement of the hoist along the cable;

a casting, said sheave mounted for movement with said casting;

two stirrups connected to said frame, said sheave positioned between said stirrups; and frame guide means mounted to said casting and said stirrups, said frame guide means keeping said casting vertically aligned with same frame.

29. A hoist apparatus for moving a load along a cable comprising:

a frame;

cable biasing means attached to said frame; and a rotatably mounted traction sheave, said sheave also mounted below said cable biasing means for movement relative to said frame within a limited range toward and away from said cable biasing means, said sheave having a circumferential peripheral groove receiving the cable, said cable biasing means pressing the cable into said groove when said sheave is positioned adjacent said cable biasing means such that a frictional force between said cable and said sheave is produced which allows rotational movement of said sheave to translate into corresponding movement of the hoist along the cable.

* * * * *